US011524325B2

(12) United States Patent
Graham

(10) Patent No.: US 11,524,325 B2
(45) Date of Patent: Dec. 13, 2022

(54) FRICTION FORMING

(71) Applicant: GKN Aerospace Services Limited, East Cowes (GB)

(72) Inventor: Daniel Graham, East Cowes (GB)

(73) Assignee: GKN Aerospace Services Limited, Isle of Wight (GB)

( * ) Notice: Subject to any disclaimer, the term of this patent is extended or adjusted under 35 U.S.C. 154(b) by 273 days.

(21) Appl. No.: 16/618,425

(22) PCT Filed: Jun. 1, 2018

(86) PCT No.: PCT/GB2018/051510

§ 371 (c)(1),
(2) Date: Dec. 2, 2019

(87) PCT Pub. No.: WO2018/220400

PCT Pub. Date: Dec. 6, 2018

(65) Prior Publication Data

US 2020/0114409 A1 Apr. 16, 2020

(30) Foreign Application Priority Data

Jun. 2, 2017 (GB) ..... 1708828

(51) Int. Cl.
*B21D 22/16* (2006.01)
*B21D 53/92* (2006.01)

(52) U.S. Cl.
CPC ..... *B21D 22/16* (2013.01); *B21D 53/92* (2013.01)

(58) Field of Classification Search
CPC ..... B21D 22/14; B21D 22/16; B21D 53/92; B21D 31/005
See application file for complete search history.

(56) References Cited

U.S. PATENT DOCUMENTS 7,448,528 B2 * 11/2008 Forrest ..... B21D 22/16 228/112.1
7,971,463 B2 * 7/2011 Forrest ..... B21D 22/16 72/67

FOREIGN PATENT DOCUMENTS

| | | | |
|---|---|---|---|
| CN | 1623763 | A | 6/2005 |
| CN | 1730189 | A | 2/2006 |
| CN | 104630679 | A | 5/2015 |
| CN | 106794548 | A | 5/2017 |
| DE | 102008020242 | A1 | 5/2009 |
| EP | 1506832 | A2 | 2/2005 |
| JP | 2017051995 | A * | 3/2017 |
| JP | 2017051995 | A | 3/2017 |
| WO | 2011057748 | A1 | 5/2011 |

OTHER PUBLICATIONS

Machine Translation for JP-2017051995-A (Year: 2017).*
Chinese Office Action for CN201880036476.7 dated Nov. 3, 2020 (41 Pages; English translation not available).
International Search Report and Written Opinion for PCT/GB2018/051510 dated Sep. 5, 2018 (15 pages).

* cited by examiner

*Primary Examiner* — David P Bryant
*Assistant Examiner* — Christine Bersabal
(74) *Attorney, Agent, or Firm* — Bejin Bieneman PLC

(57) ABSTRACT

A method of forming a component by applying a forming load to a blank of material against a mandrel, wherein the mandrel defines the shape of the component to be formed and applying a forming load as a combination of a localised force and localised friction heating.

10 Claims, 7 Drawing Sheets

FRICTION FORMING

CROSS-REFERENCE TO RELATED APPLICATIONS

This application is a national stage of, and claims priority to, Patent Cooperation Treaty Application No. PCT/GB2018/051510, filed on Jun. 1, 2018, which application claims priority to Great Britain Application No. GB 1708828.7, filed on Jun. 2, 2017, which applications are hereby incorporated herein by reference in their entireties.

BACKGROUND

The present disclosure relates to a manufacturing technique for forming leading edge components of aircraft. A 'leading edge' in the aerospace field is a surface which faces the direction of travel i.e. high speed air makes direct contact with the leading edge. Leading edges can be found, for example, on wings, blades, lip skins on nacelles that are located at the inlet to a gas turbine engine or the like.

Leading edges must be carefully designed to accommodate a variety of thermal and structural loads. Importantly, leading edges must also be designed to accommodate extreme environmental conditions, such as ice and rain which may cause corrosion or wear. Furthermore, leading edges must be designed to accommodate unexpected collisions, for example caused by a bird-strike or otherwise un-expected collision with a leading edge.

The aerodynamic profile or shape of a leading edge (such as a nacelle inlet lip skin) makes manufacturing a complex process in the sense that a smooth curved geometry is needed to provide a smooth surface against which the airstream can flow in normal flight.

FIG. 1 shows an example leading edge component, an engine nacelle. The gas turbine engine 1 is contained within an external structure which is known in the art as a nacelle. The nacelle defines an air inlet into the structure (and engine) at its foremost part. The inlet 2 is generally circular and has a smooth leading edge surface. FIG. 2 shows a cross-section of the inlet 2 and illustrates the curvature of the nacelle. It will be recognised that the nacelle needs a smooth leading edge surface to split and direct air into the engine and also along the outside of the engine case (as illustrated by the arrows shown in FIG. 2).

In order to form a leading edge component with the profile shown in FIGS. 1 and 2 a common forming process is used which is known as 'spin forming'. This involves a large rotating mandrel against which a disc of metal is pressed to form the final shape of the nacelle. This is illustrated in FIG. 3.

Referring to FIG. 3, a rotatable mandrel 4 is provided defining the nacelle (or other leading edge) profile. A disc of metal 5 is coupled to the end of the mandrel so as to rotate therewith. As the mandrel 4 and disc 5 rotate, a roller 6 presses against the disc forcing the material progressively onto the mandrel surface (shown by ghost profiles A, B and C). The roller 6 moves around the mandrel and applies a force against the material until the material is aligned with the mandrel's outer surface forming the nacelle shape. As shown, and as discussed above, the wall thickness $T_1$ can be controlled within a specified tolerance so as to provide the strength required of the leading edge.

Because materials have formability limits in terms of the stress and strain they can accommodate before failure, certain applications require heat to be applied to the material as it is formed by the roller 6. This is conventionally by means of a flame 7 from a gas blow torch 8 directed on the material as it is being formed by the roller 6.

Forming the leading edge in this way causes the material to be strained in multiple directions. Although this results in thickness changes the changes are controlled within a specified tolerance.

Heating the material during the forming as described above advantageously improves the formability and allows the shape to be conveniently formed. However, the application of heat in this way is not always precise and can cause varied heat distribution i.e. under or overheating of the material during the forming process. This can degrade the material with a resulting reduction in strength and fatigue life. The material is also prone to fracture during forming which generates waste or scrap. Furthermore, there are also health and safety issues associated with naked flame use and the required flammable fuel.

SUMMARY

Described herein, is a method of forming a component which includes applying a forming load to a blank of material against a mandrel, said mandrel defining the shape of the component to be formed, wherein the forming load is applied as a combination of a localised force and localised friction heating.

Thus, a process is provided herein in which a force and heat are simultaneously applied at a discrete part of the blank material wherein the heating is caused by friction between the tool applying the forming load and the blank material itself.

The term 'localised' means herein that the force and heat is applied to a portion of the blank surface at a time, i.e., the surface of the blank is incrementally processed according to the method and apparatus as opposed to a single shot process. The method is applied to the blank surface incrementally biasing the blank towards and against the mandrel surface until the blank conforms to the profile or shape of the mandrel (described in more detail below).

Although it would be expected that creating heat using friction at a point where load is applied would cause damage to the blank material resulting in an unacceptable component, creating heat using friction whilst simultaneously applying a forming load or force provides advantages. This is particularly the case for leading edge components or the like but offers advantages in other applications.

In conventional cold forming techniques, strain and deformation are induced into the material. Additionally, dislocation density increases as a result of the cold work. In contrast, according to the present disclosure, this is not the same as actively disrupting/shearing the microstructure with a rotating tool has the advantageous effect of refining the grain size and improves the material properties in the ways discussed herein.

Using friction between the load bearing tool and the blank material creates highly localised and accurate heating whilst simultaneously applying a force to deform the blank towards and onto the mandrel.

The term blank is used herein to refer to the material (metal) that is to be deformed onto the mandrel to create the desired component shape. This may, for example, be a circle or disc of metal, such as aluminium, which is to be formed over the mandrel into a nacelle shape.

The mandrel may be provided with a fixing, such as a securing bolt that passes through part of the blank, to secure the blank to the mandrel as the forming process takes place. This ensures that the desired shape can be formed accurately.

Thus, in an arrangement where the mandrel rotates during the forming process the mandrel and the blank rotate or move together i.e. as one.

As discussed above, the localised force and localised friction are applied and generated simultaneously at the same portion of the blank surface. This prevents under or over heating of portions of the blank which can occur with conventional manufacturing processes. Additionally, it prevents repeated heating of the blank material which can occur during a conventional manufacturing process where control of where heat is applied is extremely limited.

The process allows for precision control of the force and the heat at the same point. The process may, for example, be achieved using computer numerically controlled robotic arms or the like.

The method may advantageously be performed in stages, for example, the blank may be processed so as to move towards the mandrel in a series of stages. The force and friction heating may be applied along and/or around the mandrel to minimise any induced stresses and to control the wall thickness of the blank and prevent excessive straining of the material which might cause wall thickness reductions.

The blank and mandrel may be moved and the forming head which applies the force and heat may be stationary. Alternatively, the forming head may move relative to the mandrel and blank which remain stationary. Advantageously the mandrel/blank and the forming head which applies the heat and force may both move relative to one another to allow a complex shape to be accurately formed. For example, the mandrel may be arranged to rotate and the forming head arrange to reciprocate against the blank surface. The forming head may be mounted on a multi-axis robotic arm allowing very complex geometries to be formed.

The friction heating applied by the forming head may be applied in a variety of ways, i.e., friction between a distal part of the forming head and the surface of the blank.

For example, the forming head may be arranged to rotate such that the rotating surface of the head contacts the surface of the blank creating friction and heat. The head may, for example, comprise a wheel or disc which rotates and continuously engages with the surface of the blank creating continuous friction and heat as the two surfaces interact. The head may be arranged to move in a circular 'orbital' profile against the blank surface; the contact between the surfaces creating the desired friction and heat.

Alternatively, a penetrative head may be used such as that used in friction stir processes like friction stir welding. Here a distal part of the head, a 'probe' or 'pin' rotates at speed and is biased or forced against the surface. The probe creates friction and heat and plasticises the material. The force applied to the probe causes the probe to penetrate the softened plasticised material. The probe may advantageously be surrounded circumferentially by a shoulder which comes into contact with the surface of the blank as the probe penetrates into the softened material. The shoulder then advantageously applies further loading to a greater area than the probe which causes displacement of the blank towards the mandrel. Thus, the force applied to the forming head first causes plasticisation of the material and also displacement of the blank towards the mandrel. In effect, local displacement and plasticisation are thereby achieved.

In another arrangement, the distal portion of the forming head may be arranged to vibrate in such a way that friction is caused thereby generating heat. The vibrations may, for example, be lateral with respect to the elongate axis of the distal portion of the head, i.e., the distal portion may vibrate in a perpendicular plane with respect to the elongate axis of the head. As the distal end abuts with the blank surface the 'side-to-side' reciprocating movement causes the desired friction and heat to be generated as the force is applied. The vibrations could be generated in a variety of ways including, for example, an ultrasonic probe.

It may also, in an alternative arrangement, be possible to generate the desired heat by heating the distal part of the forming head which abuts with the blank surface. For example, the forming head could be fitted with an induction coil arranged to heat the head during the forming process.

A combination of one or all the above friction and heating techniques may be conveniently used depending on the application and in particular the material to be formed.

Advantageously the friction and heat are selected so as to plasticise the metallic material of the blank. Advantageously, by controlling the heat applied to the material using a friction stir process, the grain structure of the metal is refined, resulting in more favourable mechanical properties including strength, ductility and wear resistance.

The apparatus may further advantageously be arranged to introduce other materials into the practised 'pool' of material formed during the process. For example, ceramics may be introduced to improve wear resistance. Other materials, fibres or metals could also be introduced.

In another example, there is provided a method of manufacturing a leading edge aerospace component by simultaneously applying force and heat incrementally to a blank surface to bias the blank onto a mandrel or mould.

In another example, there is provided a forming apparatus comprising a mandrel arranged to receive a blank of material, said mandrel having an outer surface defining the shape of a component to be formed, said apparatus comprising a forming head arranged in use to incrementally force portions of the blank towards the outer surface of the mandrel, wherein the forming head is configured to apply a force to said portion of the blank surface and to simultaneously apply heat to the same portion of the blank surface.

In another example, there is provided a leading edge forming apparatus comprising a mandrel and a forming head, said forming head arranged to bias a blank of material against the mandrel, wherein the forming head applies a force against a portion of the outer surface of the blank and simultaneously applies heat to the same portion.

The apparatus may comprise a forming head itself comprising a friction stir processing apparatus.

In another example, there is provided a machining centre comprising a forming apparatus as described herein. In another example, is a machining centre arranged in use to carry out a method as described herein.

In another example, described herein there is provided a method of forming a component, the method comprising applying a forming load to a blank of material against an opposing biasing force, the biasing force being used to define the shape of the component to be formed, wherein the forming load is applied as a combination of a localised force and localised friction heating.

Disclosures herein extend to manufacturing one or more of the following components using a method and apparatus described herein: Lip skins, wing leading edges, wing cover skins, fuselage skins and nacelles.

DRAWINGS

Examples will now be described with reference to the accompanying figures in which.

Figure 1:
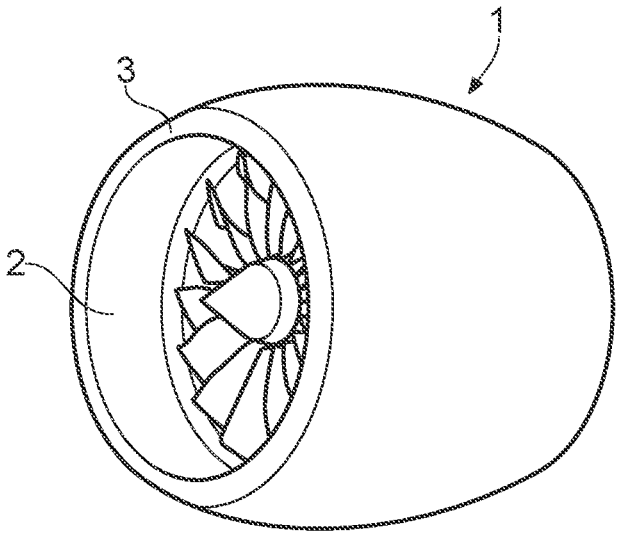
FIG. 1 shows a gas turbine engine and engine nacelle.
Figure 2:
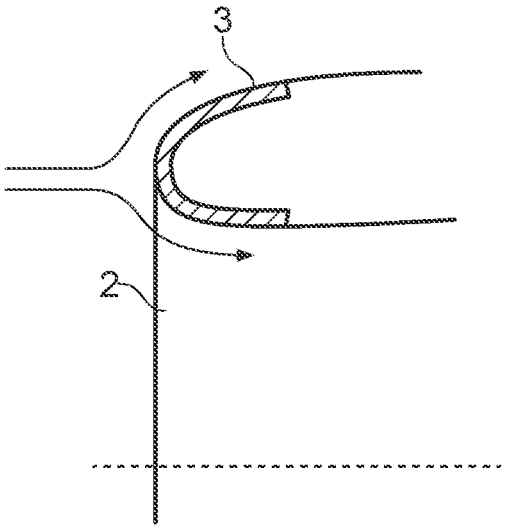
FIG. 2 shows a cross-section of the engine nacelle of the engine shown in FIG. 1.
Figure 3:
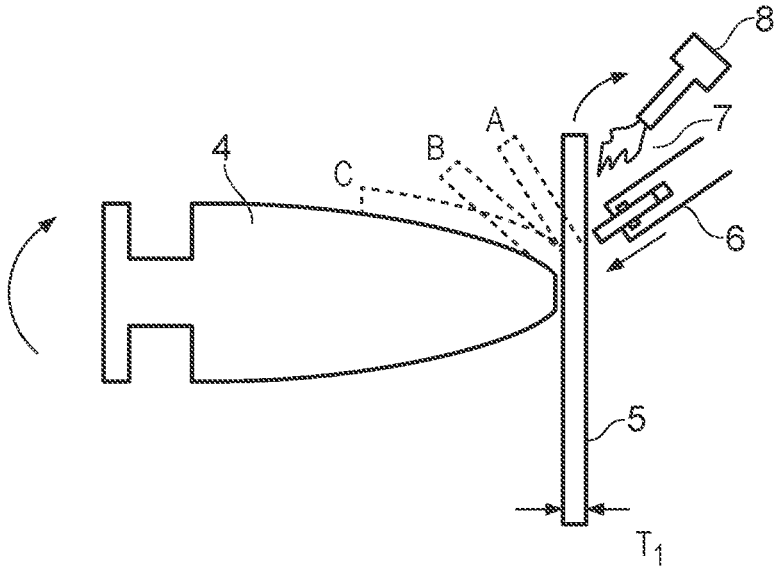
FIG. 3 illustrates the conventional manufacturing process for nacelle manufacture using a mandrel, roller and flame heater.

While the invention is susceptible to various modifications and alternative forms, specific examples are shown in the drawings and are herein described in detail. It should be understood, however, that drawings and detailed description attached hereto do not limit the invention to the particular form disclosed but rather the invention is to cover all modifications, equivalents and alternatives falling within the spirit and scope of the claimed invention It will be recognised that the features of the examples described herein can conveniently and interchangeably be used in any suitable combination

DETAILED DESCRIPTION

The principle behind the present disclosure is to perform two processes simultaneously to form a component such as a leading edge of an aircraft. One example is a nacelle which must exhibit the required strength whilst being light and resistant to corrosion and wear.

By using a modified friction stir process, in combination with a conventional forming process, significant advantages can be realised. For example, using a friction stir process to modify the grain structure of the material being used to form the component can greatly reduce the degradation of the alloy that can occur with conventional processes. The material grain structure can also be refined which improves mechanical properties such as strength and wear resistance.

During a friction stir process, the material is heated so as to soften and plasticise but importantly it is not heated such that it melts. Preventing melting during the manufacturing process significantly enhances material properties. The forming tool of the present disclosure (described in detail below) causes the material to plasticise using heat generated by friction between the tool and the blank material. The component is simultaneously formed into the desired shape by the force which is applied to generate the friction. The forming head is movable whilst the plasticisation occurs allowing a shape to be formed against a mould or mandrel.

There is a synergy in the present disclosure in that:

(a) the forming of the blank into the desired shape is facilitated by the softened state of the material (as a result of heating by friction or other heating). This means the blank can be conveniently formed into complex shapes, such as an engine nacelle profile;

(b) it has been demonstrated in the field that the refined microstructure associated with friction stir processing can in fact enhance the inherent formability of the material; and (c) the mechanical properties of the material are simultaneously enhanced by applying a friction stir process which disturbs the microstructure of the material at the outer surface providing, amongst others, the benefits described herein. For example the friction stir process creates a more refined microstructure which can lead to a harder surface with improved erosion resistance. Additionally friction stir processing can advantageously improve corrosion resistance in some commonly used aluminium alloys.

It should be recognised that whilst the friction stir process is discussed in some detail herein, any process which disrupts the microstructure in the same way whilst forming the component is equally advantageous. The disclosure herein extends to other forms of heating the blank material during forming.

Any example machining process will now be explained with reference to FIGS. 4 to 6.

Figure 4:
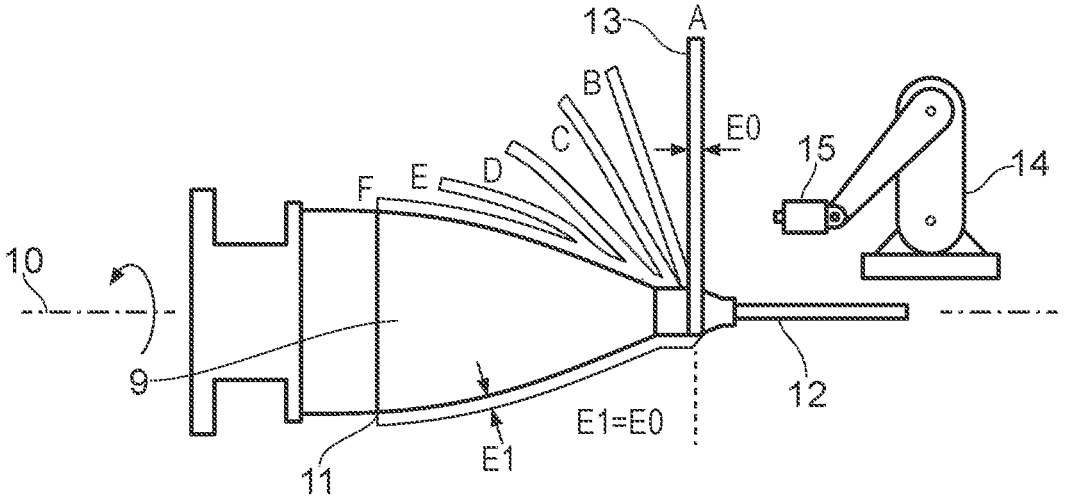
FIG. 4 shows an apparatus as described herein.

FIG. 4 shows the components of the machining apparatus.

The example shown in FIG. 4 is a rotating mandrel used to form a leading edge of an engine nacelle. The present disclosure is not limited to this component and can be applied to any component which is suitable for the friction forming process of the present disclosure.

The mandrel 9 is arranged to rotate by means of a drive unit (not shown) around the elongate axis 10 of the mandrel body. The outer surface 11 of the mandrel defines the desired shape of the final component. At the opposing end of the mandrel a coupling 12 is provided which secures the mandrel about the elongate axis at the second distal end and also secures a blank of material 13 to the end of the mandrel.

Adjacent to the mandrel is a multi-axis robotic arm which is CNC controlled according to a machining programme, as discussed below. The robotic arm is arranged to move a forming head 15 with respect to the mandrel and blank material. The forming head is described in detail below.

In use the mandrel is rotated causing the blank 13 and mandrel to rotate together. The blank 13 in shown above the axis 11 in a series of incremental formed positions A to F. Position F corresponds to the blank's position below the axis 10 where it has been biased against the mandrel surface 11. This corresponds to position F above the axis 11.

The robotic arm (or in another arrangement a conventional multi-axis head or parallel kinematic machine) is programmed to complete a path during the manufacturing process to apply a force against the blank surface as the mandrel rotates. With sufficient reach and movability, the mandrel may not need to be rotated if the robotic arm (or the like) could navigate around the entire component.

Returning to the rotating mandrel in FIG. 4, the robotic arm forces the forming head against the blank surface to progressively and incrementally move the blank material from position A through, B, C, D, E and to F as the mandrel rotates.

The forming head not only provides a forming load or force which is applied to the blank but it also generates simultaneous heat which is applied to the blank surface.

Figure 5A:
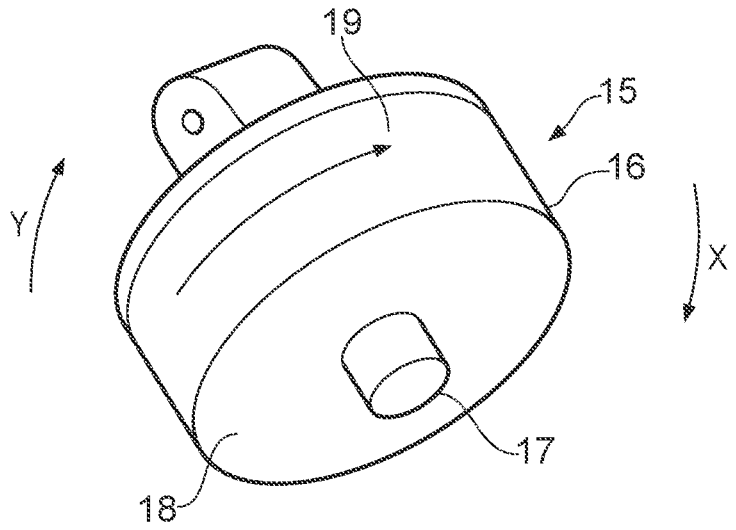
FIG. 5A shows one embodiment of a forming head.

The way the heat is generated in combination with the load application will be described with reference to FIG. 5A.

The forming head 15 includes a rotatable portion which is formed of a main body 16 and probe 17. The main body defines a shoulder 18 extending radially from the probe. The body and probe are arranged along the same axis. The body is arranged to rotate with respect to the connecting lug 19 which couples the forming head to the robotic arm 14. The rotating head may be caused to rotate by any suitable means, such as a high speed electric motor.

Figure 5B:
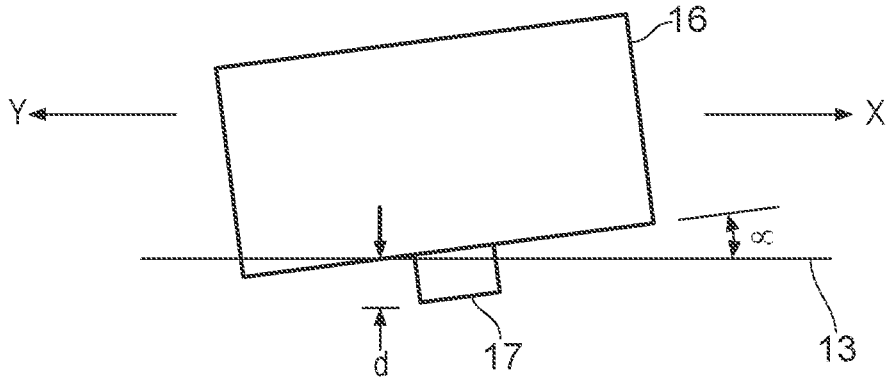
FIG. 5B shows a cross-section of the forming head in engagement with the blank material surface.

Turning to FIG. 5B, the forming head 15 is shown in contact with the blank material 13. In fact the forming tool has penetrated the material as described in more detail below.

In use, the forming head is activated to cause high speed rotation of the body and probe.

The precise rotating speed of the probe, angle of incidence and force applied will depend on the materials being processed amongst other factors. One example of process parameters are as follows:

Temperature by necessity must not exceed the melting temperature of the material. For aluminium alloys, typically parameters are selected to ensure temperature stays below 500° C.

Typical processing conditions for an aluminium alloy could be of the order of 300 RPM tool rotational speed, and 200 mm/min tool traverse speed. The precise parameters vary dependent on a range of factors including material grade, material thickness, tool heat sinking characteristics and so forth. Forge/forming force could be in the range of tens of Newtons to kilo-Newtons dependent on the aforementioned parameters, the amount of form required in the part, and the support structure/tool design.

As an example, the processing temperature may be up to around 80% of the melting temperature of the material.

The robotic arm is activated according to its programme and/or proximity sensors and slowly brings the probe into contact with the blank surface as it rotates. Heat is generated by friction between the end of the probe and the blank material until the heat causes plastic flow of the blank material around the probe. The robotic arm then applies an increased force causing the pin to penetrate the surface of the material to a predetermined depth d.

The robotic arm then rotates the forming head with respect to the surface of the blank be a predetermined angle alpha. This causes the shoulder 18 to engage with the blank surface to apply a loading (this loading causes the biasing or movement between A and F shown in FIG. 4). Next, the robotic arm moves the forming head in the direction X along the surface of the blank.

Figure 5C:
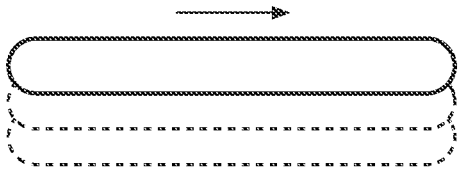
FIG. 5C shows the tracks or paths produced by the forming head along the blank surface.

FIG. 5C shows the trail in the material that is left behind caused by the advancing side of the forming head (where the rotation is in a X direction) and an opposing trailing side of the forming head (where rotation is in the Y direction). Multiple passes (shown as ghost lines) show how an entire surface can be processed incrementally.

The metallurgy behind the process that occurs by means of the apparatus described above will now be described with reference to FIGS. 6A and 6B which illustrate the microstructure of the material before and after the tooling has passing through the material.

The rotating tool passes through the material, generating heat via friction, and causing physical disruption to the microstructure at the present location of the tool and immediate vicinity. Where the tool 'plunge depth' is smaller than the thickness of the material, generally the 'stirring' caused by the pin in the plasticised material disturbs the surface layer.

Figure 6A:
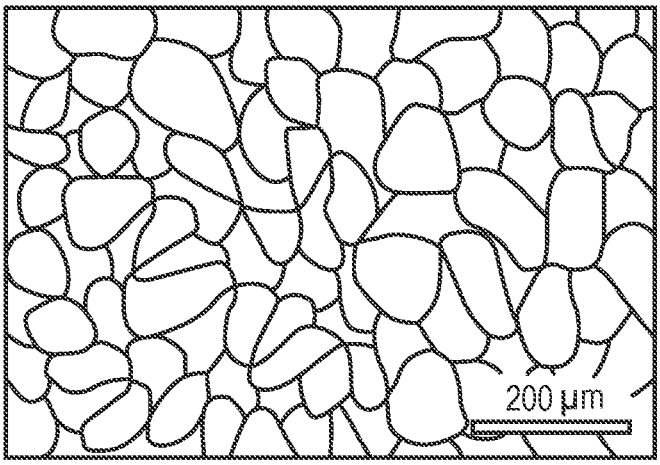
FIGS. 6A and 6B illustrate the microstructure of an example aluminium material before and after the penetrative process has been performed, respectively.

FIG. 6A illustrates an aluminium blank before the process has occurred.

Figure 6B:
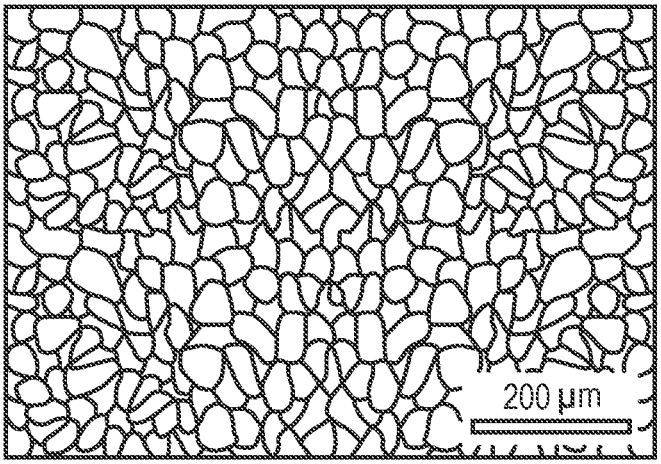

FIG. 6B illustrates the same aluminium blank after the process.

As shown in FIG. 6B, the microstructure after processing is much more refined, with a relatively uniform grain distribution in the processed area.

The process can cause substantial changes in the mechanical properties of the material in terms of strength, erosion resistance, ductility and corrosion performance, which are inherently useful in a leading edge component. This is largely possible because the process does not melt the material but merely plasticises it and disrupts the microstructure.

Figure 7:
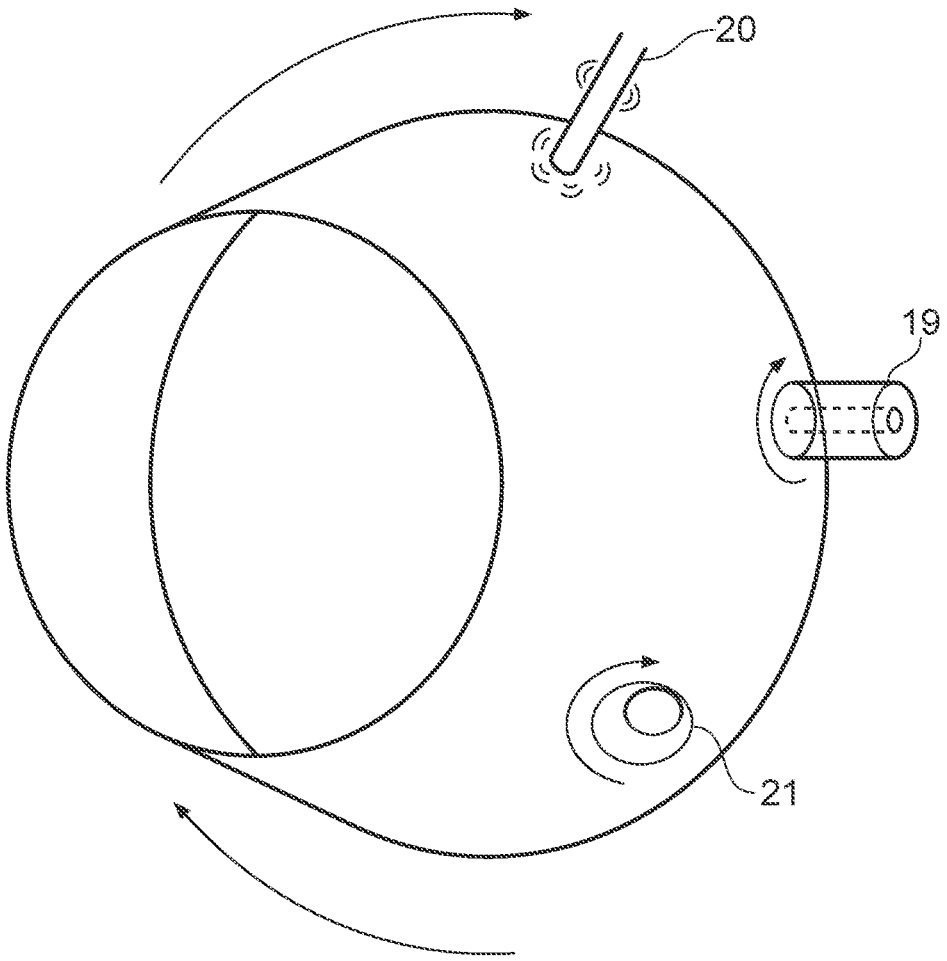
FIG. 7 illustrates alternative means to generate the heat to plasticise the material.

Although a rotating penetrating probe has been described above, other forms of generating the heat needed to plasticise the blank could equally be used as illustrated in FIG. 7.

FIG. 7 illustrates three alternative means to apply friction heating into the material.

One example is an orbital penetrative tool 19. This is a rotating tool that may, for example, be mounted onto a robotic arm to achieve the present process (as described above).

A second example is a vibrating tool 20. Such a tool may reciprocate at high speeds and be brought into contact with the material so as to achieve the 'stirring' of the grain structure as described herein.

A third example is an orbital surface tool 21 which, instead of reciprocating like the vibrating tool 20, rotates or obits about a central axis. Friction and force may then be applied to the material in the same way.

Figure 8A:
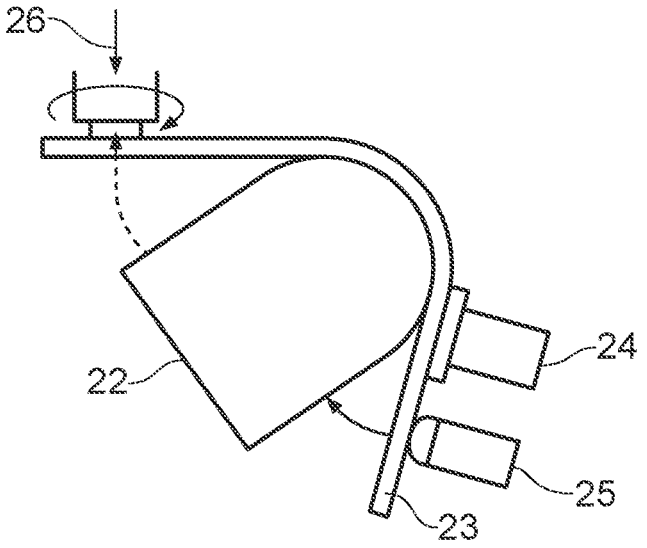
FIGS. 8A and 8B show further examples as described herein.
Figure 8B:
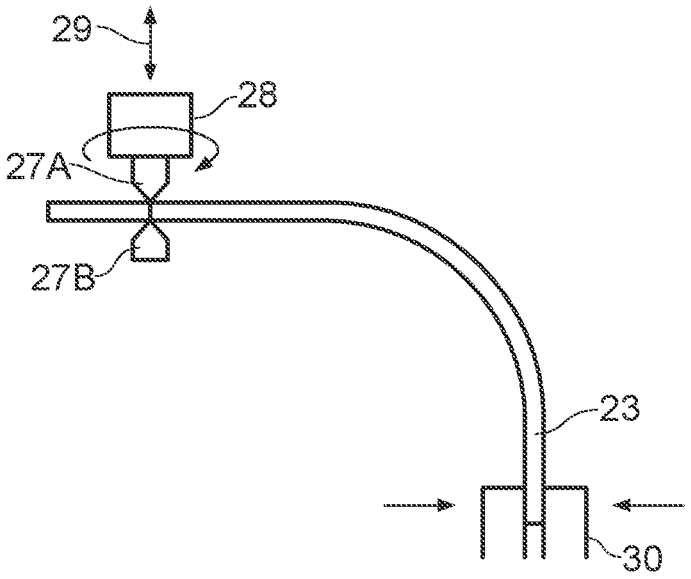

FIGS. 8A and 8B show a further example in which the grain structure can be 'stirred' or refined whilst simultaneously applying a forming load to generate a desired final form or shape.

Referring to FIG. 8A, a mandrel 22 the material 23 to be processed is brought into contact with the mandrel. Two alternative arrangements are in fact shown in FIG. 8A.

A first approach is to use a combination of friction head 24 and forming head 25 simultaneously. The grain structure stirring is achieved by means of the friction head 24 and causes the refinement of the grain structure as described with reference to the other embodiments above. Simultaneously, a forming head 25 applies a load in the direction of the arrow to bias the material 23 against the mandrel. The heating effect of the friction head softens the material causing it to deform towards the mandrel on application of the load from the load head. Spacing the friction head and forming head allows for a greater bending moment to be achieved.

Advantageously applying the friction stirring process and forming load separately in this way means that changes to the grain structure can be applied separately from the load, i.e., not all of the material need be processed by the friction stir process whilst simultaneously allowing the material to be brought into contact with the mandrel to form the desired shape. FIG. 8A also shows a combined friction head and loading head 26 in which the friction stir process and loading are applied at the same point. Again, the loading causes the material to be biased towards the mandrel to form the desired shape in combination with the grain refinement provided by the stirring process.

FIG. 8B shows a further example which utilises a modified double sided friction stir welding head. The double sided head comprises two components 27A, 27B which are coupled together and pass through the material 23. The two are coaxial and arranged to be rotatable. The two components are coupled to a rotating head which causes the components 27A, 27B to rotate and generate the friction described above with reference to the other embodiments. In this arrangement, the two components then rotate and are moved through the material in the same way as described above (for example by means of a robotic arm of the like). The head may also be arranged to provide a loading force 29 which can be used to deform the material. As shown by restraining one part of the material in a vice 30 or the like, the friction forming head 28 (comprising the two components 27A and 27B) can be used to refine the grain structure whilst simultaneously causing the material to deform into a desired shape. This may be used in combination with a mandrel (not shown) or without a mandrel (as shown in FIG. 8B).

In other examples, the friction head 24 at which the friction stir process is carried out may be positioned at a first location whilst a loading (or biasing) head/tool may be positioned at a second location. This loading tool may form the material 23 through, for example, local point loading, pressing or stretching type operations (but is not limited thereto). The second location may be distal or remote from the first location.

Thus the head 24 and biasing head may be located in different positions with respect to the material being formed. Thus, in some examples, a mandrel may not be used but instead the biasing force is provided by a stationary or movable head separate from the friction stir forming head, i.e., decoupled plasticising/forming using the friction tool to plasticise in one location, and a different tool to form through local point loading, pressing, or stretching type operations initiated from a different location.

Furthermore, heat friction may be applied (without the mandrel) with other vibrating/rotating tools different from friction stir tool. A double sided tool that 'self-reacts' forces on both sides of the plate may be used with one face of a law' comprising the FSW apparatus and an opposing law' providing the biasing force.

Such arrangements (without a mandrel) may provide a number of advantages including (but not limited to): no mandrel costs, more adaptable processes, more optimisation potential and the option to form larger components.

The discussion herein relating to a method and apparatus comprising a mandrel applies equally to an arrangement and method wherein the mandrel is replaced by a local or remote biasing force.

According to such an example (which may be used in combination with the other embodiments described herein) the friction stir head is used to soften or plasticise the material such that the material may begin to flow and flex, i.e., to change in shape. Only small amounts of force need then be applied to change the shape of the material into the desired profile. More specifically, by plasticising the material using the friction stir welding head a force is not essential against a mandrel to create a desired profile or shape. This may advantageously allow large components to be formed without the need for large and costly mandrels. Thus, components with large surface areas may be formed using an apparatus and method described here.

Different examples to achieve both friction enabled grain refinement and deformation may be combined together in any suitable arrangement.

In another example, the apparatus described herein may additionally or alternatively be configured to include conventional machining tool functionality, in effect a friction forming machine fitting with machine tool functionality.

For example, the apparatus may be provided with machining/grinding or polishing functionality (or other finishing process). Thus, an apparatus may be provided that is optimised for forming but which additionally enables a wider range of products or higher quality parts to be manufactured; this may be a bespoke friction forming machine.

The invention claimed is:

1. A method of forming a component, the method comprising: applying a forming load to a blank of material against a mandrel, said mandrel defining the shape of the component to be formed, wherein the forming load is applied as a combination of a localised force and localised friction heating, wherein the localised force and the localised friction heating are applied by a rotatable head comprising a shoulder that engages with a surface of the blank at a predetermined angle between a surface of the shoulder and the blank surface to apply the localised force to the blank surface, the predetermined angle being nonzero.

2. The method of claim 1, wherein a portion of the blank is connected to the mandrel such that the blank and the mandrel rotate or move as one.

3. The method of claim 1, wherein the localised force and localised friction are simultaneously applied to a portion of the blank surface.

4. The method of claim 1, wherein the blank, the mandrel, the localised force, and the localised friction are moved relative to each other until the blank of material has been brought into contact with an outer surface of the mandrel.

5. The method of claim 4, wherein the blank and the mandrel are moved relative to the localised force and the localised friction or the localised force and localised friction are moved relative to the blank and the mandrel.

6. The method of claim 1, further comprising rotating the blank and the mandrel such that the localised force and the localised friction arc arranged to simultaneously move along the blank surface.

7. The method of claim 1, wherein the localised force and the localised friction are applied to incremental portions of the blank surface.

8. The method of claim 1, wherein the localised force and localised friction are applied by the rotatable head comprising a distal portion arranged to apply a force to the blank surface and wherein the rotatable head is a friction stir welding apparatus.

9. The method of claim 8, wherein the rotatable head is in the form of a rotatable wheel or disc, the method further comprising biasing and rotating the rotatable wheel or disc against the blank surface.

10. The method of claim 1, wherein the localised force and the localised friction are applied by the rotatable head comprising a distal portion arranged to apply a force to the blank surface and further arranged to vibrate in a plane perpendicular to an elongate axis of the distal portion.

* * * * *